US010885890B2

(12) United States Patent
Pezeshkian

(10) Patent No.: US 10,885,890 B2
(45) Date of Patent: Jan. 5, 2021

(54) SYSTEMS AND METHODS FOR CONTROLLING AUDIO DEVICES

(71) Applicant: Nebula Music Technologies Inc., Santa Rosa, CA (US)

(72) Inventor: Pouria Pezeshkian, Santa Rosa, CA (US)

(73) Assignee: Nebula Music Technologies Inc., Santa Rosa, CA (US)

( * ) Notice: Subject to any disclaimer, the term of this patent is extended or adjusted under 35 U.S.C. 154(b) by 0 days.

(21) Appl. No.: 16/432,897

(22) Filed: Jun. 5, 2019

(65) Prior Publication Data

US 2019/0371287 A1 Dec. 5, 2019

Related U.S. Application Data

(60) Provisional application No. 62/680,768, filed on Jun. 5, 2018.

(51) Int. Cl.
*G10H 1/00* (2006.01)
*G10H 3/18* (2006.01)

(52) U.S. Cl.
CPC ..... *G10H 1/0008* (2013.01); *G10H 3/186* (2013.01); *G10H 2230/025* (2013.01); *G10H 2240/201* (2013.01)

(58) Field of Classification Search
CPC ..... G10H 1/0066; G10H 2240/056; G10H 2240/145; G10H 2240/311; G10H 2210/235; G10H 2210/311; G10H 2210/346; G10H 2240/325; G10H 2210/201; G10H 2250/041; G10H 2230/041; G10H 2240/131; G10H 7/008; G10H 2210/251; G10H 2240/105; G10H 2210/195; G10K 15/04
See application file for complete search history.

(56) References Cited

U.S. PATENT DOCUMENTS 6,816,833 B1 * 11/2004 Iwamoto ..... G10H 1/366 381/61
7,030,311 B2 * 4/2006 Brinkman ..... G06Q 20/00 709/203
7,915,514 B1 * 3/2011 Shrem ..... G10H 1/0075 84/615

(Continued)

*Primary Examiner* — Marlon T Fletcher
(74) *Attorney, Agent, or Firm* — Zeller IP Group, PLLC; Kyle M. Zeller

(57) ABSTRACT

Various systems and methods are disclosed to allow users to conveniently control characteristics of sounds generated by musical instruments. Exemplary systems include a control unit in communication with any number of audio processing devices ("APDs"). The control unit may be operable to transmit control signals to each of the APDs, wherein the control signals include settings information relating to one or more APD processing parameter values. The control unit may be further operable to receive an audio signal generated by an instrument and transmit the same to the APDs. Accordingly, upon receiving the control signal and the audio signal from the control unit, the APDs may update their processing parameters based on relevant settings information contained in the control signal and process the audio signal into a processed audio signal, based on the updated processing parameters.

18 Claims, 11 Drawing Sheets

(56) References Cited

U.S. PATENT DOCUMENTS

| | | | | |
|---|---|---|---|---|
| 2005/0092163 | A1* | 5/2005 | Aiso | G10H 1/46 84/625 |
| 2005/0103188 | A1* | 5/2005 | Takemura | G11B 27/034 84/609 |
| 2006/0180009 | A1* | 8/2006 | Komano | G10H 1/0066 84/645 |
| 2006/0180010 | A1* | 8/2006 | Nakazono | G10H 1/0066 84/645 |
| 2007/0227342 | A1* | 10/2007 | Ide | G10H 1/0058 84/645 |
| 2009/0049979 | A1* | 2/2009 | Naik | G10H 1/40 84/636 |
| 2012/0006182 | A1* | 1/2012 | Komano | G10H 1/14 84/610 |
| 2016/0019877 | A1* | 1/2016 | Remignanti | G10H 1/0066 84/645 |

* cited by examiner

SYSTEMS AND METHODS FOR CONTROLLING AUDIO DEVICES

CROSS-REFERENCE TO RELATED APPLICATIONS

The present application claims benefit of U.S. provisional patent application Ser. No. 62/680,768, titled "Systems and Methods for Controlling Audio Devices," filed Jun. 5, 2018, which is incorporated by reference herein in its entirety.

BACKGROUND

This specification relates to systems, methods and apparatuses for controlling characteristics of sounds generated by audio devices, such as musical instruments.

Musicians often wish to add dimensions to their music in order to replicate sounds or create new sounds. Although some musical instruments include functionality to modify acoustic properties (e.g. tone, volume, pickup switching) of generated music, such functionality is typically rudimentary at best. Accordingly, musicians must employ additional signal processing accessories (i.e., "effects units") to achieve their desired sound.

The list of available effects units is virtually endless. For example, any number of effects units may be employed, in various combinations and/or sequences, to produce effects such as chorus, compressor, delay effects, distortion, expander, flanger, fuzz, gate, graphic equalizer, limiter, overdrive, phaser, pitch, phase shifter, reverb effects, rotating speaker, tremolo, talker, vibrato, vibes, and wah-wha. As another example, one or more effects units may be employed to simulate various kinds of audio equipment, such as specific preamps, amps, guitars, cabinets, pickups and stomp-boxes.

Generally, each effects unit receives two different types of signals as inputs—audio signals and control signals. The audio signals are received from the instrument or an intermediate unit and the control signals are received from a control unit. Upon receiving such signals, the effects unit processes the audio signal according to an electrical circuit or software algorithm, both of which include processing parameters that are set according to the control signals received from the control unit.

Effects units are typically controlled by a plurality of interface components (e.g., buttons, switches, knobs and/or dials), which allow the musician to access and set various processing parameters prior to playing their instrument. Unfortunately, because multiple effects units are typically employed to generate a desired sound, a musician may need to adjust a large number of interface components associated with each of the different effects units throughout a performance (e.g., when transitioning from one song to another or even when playing different parts of a single song, such as an intro, verse, rhythm, riff, and/or solo). As a result, musicians often forget the optimal configuration for each component across all effects units—especially during a live performance.

Accordingly, there remains a need for systems to allow musicians to generate a wide array of effects in music with minimal manual adjustment of component configurations. It would be beneficial if such systems could access and quickly set various processing parameter values for any number of connected effects units. It would also be beneficial if the system could allow users to create and store sets of processing parameter values relating to any number of effects units (i.e., presets), such that the system could quickly update a large number of processing parameters upon selection of a stored preset. It would be further beneficial if such systems could automatically determine optimal processing parameter values for any number of connected effects units and/or automatically adjust processing parameter values, for example, based on the occurrence of events, such as when the musician starts playing of a particular song or when the musician transitions from one section of a musical arrangement to another.

SUMMARY

In accordance with the foregoing objectives and others, exemplary applications, methods and systems are disclosed herein to allow users to conveniently control characteristics of sounds generated by musical instruments. Exemplary systems include a control unit in communication with any number of audio processing devices ("APDs"). The control unit may be operable to transmit control signals to each of the APDs, wherein the control signals include settings information relating to one or more APD processing parameter values. The control unit may be further operable to receive an audio signal generated by an instrument and transmit the same to the APDs. Accordingly, upon receiving the control signal and the audio signal from the control unit, the APDs may update their processing parameters based on relevant settings information contained in the control signal and process the audio signal into a processed audio signal based on the updated processing parameters.

In one embodiment, a method of controlling audio devices is provided. The method may include storing, by a control unit, a preset associated with settings information. The settings information may include, a first value relating to a first processing parameter of a first audio processing device ("APD") and a second value relating to a second processing parameter of the first APD. The method may further include receiving, by the control unit, an indication that a user has selected the preset; generating, by the control unit, a control signal including the settings information; and transmitting, by the control unit, the control signal to one or more APDs in communication with the control unit. Generally, the one or more APDs may include the first APD, and the control signal may cause the first APD to update the first processing parameter to the first value and/or to update the second processing parameter to the second value.

The method may also include receiving an input audio signal and transmitting the input audio signal to the first APD to, for example, cause the first APD to processes the input audio signal to a first processed audio signal based on the updated first processing parameter and the updated second processing parameter. The input audio signal may be received, by the control, from an instrument in communication with the control unit.

In one embodiment, the settings information may further include a third value relating to a third processing parameter of a second APD. Accordingly, the control unit may also transmit the control signal to signal to the second APD such that the second APD updates the third processing parameter to the third value.

In another embodiment, a method is provide wherein a preset associated with various settings information may be created, stored, and displayed to a user for selection. The settings information may include a first value relating to a first processing parameter of a first APD and a second value relating to a second processing parameter of a second APD. The method may include receiving, by a control unit, an indication that a user has selected the preset; generating, by the control unit, a control signal including the settings information; and transmitting, by the control unit, the control signal to one or more APDs in communication with the control unit. Generally, the one or more APDs may include the first APD and the second APD. Accordingly, the control signal may cause the first APD to update the first processing parameter to the first value and may cause the second APD to update the second processing parameter to the second value.

In certain cases, the method may further include receiving, by the control unit, an input audio signal; and transmitting, by the control unit, the input audio signal to the first APD. Accordingly, the first APD may processes the input audio signal to a first processed audio signal based on the updated first processing parameter. The first APD may then transmit the first processed audio signal to the second APD. And the second APD may processes the first processed audio signal to a second processed audio signal based on the updated second processing parameter.

In yet another embodiment, a system is provided that includes at least a first APD associated with a first processing parameter and a second APD associated with a second processing parameter. The system may also include a database configured to store a preset associated with settings information, such as a first value relating to the first processing parameter, and a second value relating to the second processing parameter. The system may further include a user device configured to receive user input from a user and a control unit in communication with the one or more APDs, the database, and the user device. Generally, the control unit may be configured to: receive the user input from the user device; determine that the user input includes a selection of the preset; generate a control signal including the settings information; and transmit the control signal to the one or more APDs. Accordingly, the first APD may update the first processing parameter to the first value and/or the second APD may update the second processing parameter to the second value.

The system may also include an instrument that generates an input audio signal. In certain cases the instrument may be in communication with the control unit so that the control unit may receive the input audio signal and transmit the same to the one or more APDs for processing. Additionally, the system may also include any number of audio output devices in communication with the one or more APDs. Such devices may be configured to receive and transduce processed audio signals.

The details of one or more embodiments of the subject matter of this specification are set forth in the accompanying drawings and the description below. Other features, aspects, and advantages of the subject matter will become apparent from the description, the drawings, and the claims.

DETAILED DESCRIPTION

Various systems, methods and apparatuses are disclosed herein to allow users to control characteristics of sounds generated by musical instruments. The embodiments may comprise a control unit in communication with any number of APDs. The control unit may be operable to transmit control signals to each of the APDs, wherein the control signals comprise settings information relating to one or more APD processing parameter values. The control unit may be further operable to receive an audio signal generated by an instrument and transmit the same to the APDs for processing. Accordingly, upon receiving a control signal and an audio signal from the control unit, the APDs may update their processing parameters based on the settings information contained in the control signal and process the audio signal to a processed audio signal, based on the updated processing parameters.

In one embodiment, the control unit may be in communication with one or more user devices and/or one or more remote controller units. Such devices may be adapted to receive settings information from a user (e.g., a desired value for a processing parameter associated with an APD) and transmit the same to the control unit. Upon receiving the settings information, the control unit may then transmit one or more control signals comprising the settings information to the APDs. Accordingly, such configuration allows for a user to conveniently interact with any number of APDs via a single interface.

The disclosed embodiments may further allow a user to create and store "presets" comprising settings information relating to any number of processing parameters associated with one or more APDs. Such presets may be selected by the user via a user device or remote controller unit to cause the control unit to transmit the corresponding settings information to the APDs. Moreover, certain embodiments may provide functionality to allow users to browse and download presets created by others and/or to upload and share their own presets with others.

Figure 1:
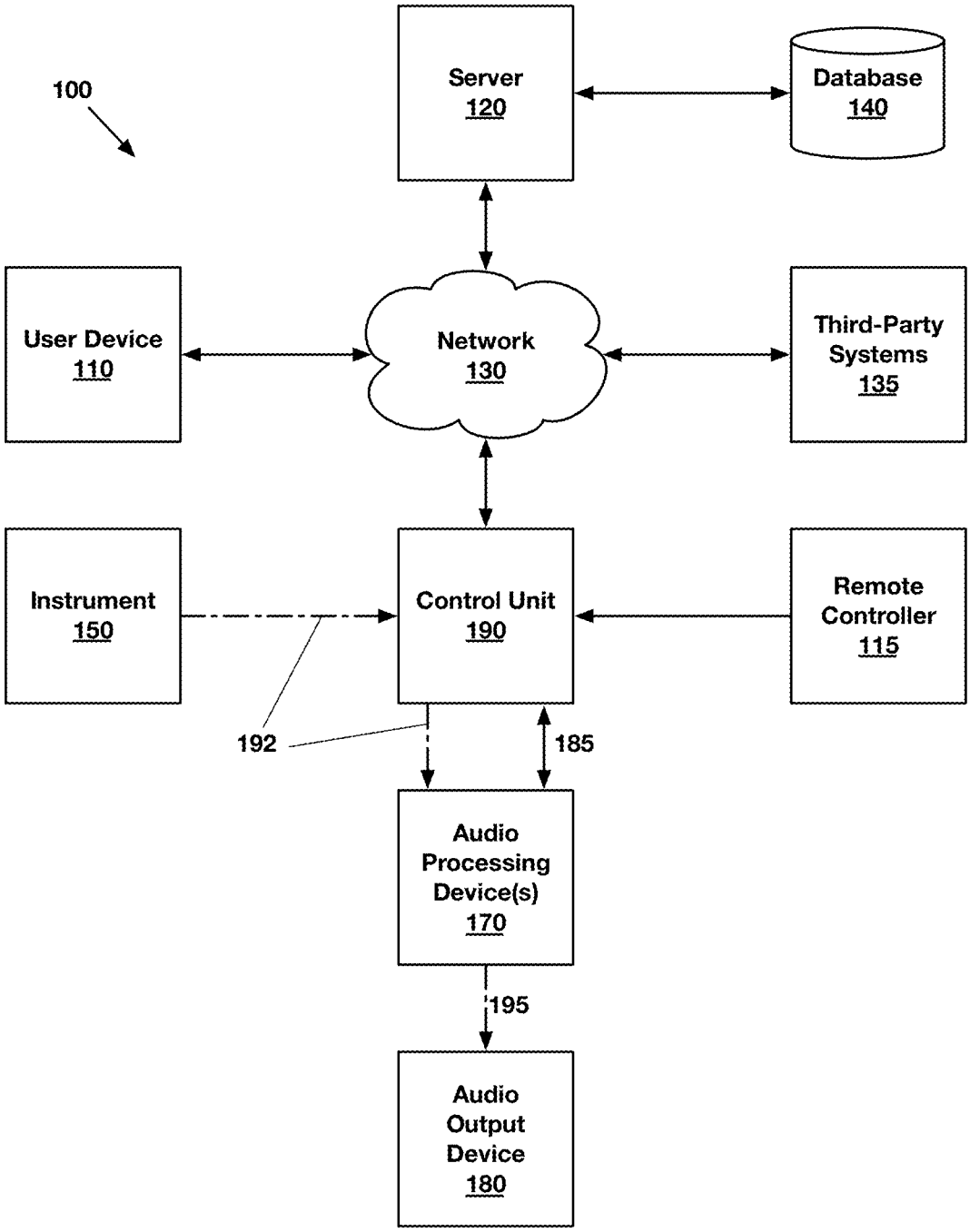
FIG. 1 shows an exemplary system 100 according to an embodiment.

Referring to FIG. 1, a block diagram of an exemplary system 100 according to an embodiment is illustrated. As shown, the system comprises an instrument 150 in communication with one or more APDs 170 (e.g., via a control unit 190) and one or more audio output devices 180 in communication with the APDs. The system may further comprise a user device 110 and a server 120 in communication with the control unit 190 via a network 130 (e.g., Internet, intranet, local-area network ("LAN"), wide-area network ("WAN"), cellular, etc.) and, optionally, any number of remote controller units 115 in communication with the control unit 190.

Generally, the instrument 150 may comprise any device that is adapted to generate an audio signal 192 (i.e., an "input audio signal"). Exemplary instruments 150 may include, but are not limited to: guitars, violins, pianos, saxophones, keyboards, synthesizers, drums, etc. Other instruments 150 may include, for example, DJ controllers, various media players, radios, and other computing machines capable of generating input audio signals.

The system may comprise any number of APDs 170 adapted to (1) receive an audio signal, (2) receive control signals comprising settings information, (3) update its processing parameters based on the received settings information, (4) process the received audio signal according to the updated processing parameters, and (5) transmit/output the processed audio signal.

Exemplary APDs 170 may include, but are not limited to, various effects units, such as tuners, wah units, overdrive units, distortion units, modulation units, delay units, volume units, compressor units, filters, graphic equalizers, etc. Additionally or alternatively, APDs 170 may comprise preamplifiers, amplifiers, tabletop effects units and/or other computing machines running audio processing software. In another embodiment, the functionality of multiple APDs may be incorporated into a single APD (e.g., a multi-effect signal processor).

The APDs may be adapted to receive audio signals transmitted from another device, such as an instrument 150, a control unit 190 and/or another APD. For example, in the illustrated embodiment, an input audio signal 192 generated by the instrument 150 may be transmitted to the APDs 170 via the control unit 190. In such case, the instrument 150 may transmit the input audio signal 192 to the control unit 190 via a wired or wireless connection and the control unit may pass the input audio signal to the APDs 170 via a wired or wireless connection.

In an alternative embodiment, the input audio signal 192 may be transmitted from the instrument 150 to the APDs 170 without passing through the control unit 190. In such cases, the APDs 170 may receive the input audio signal 192 directly from the instrument via a wired or wireless connection. It will be appreciated that one or more APDs 170 may be integral to the instrument 150 itself.

In one embodiment, the APDs 170 may receive the input audio signal 192 from an intermediate unit (not shown) located between the instrument 150 and the APDs. Exemplary intermediate units may include, but are not limited to: external signal processing units (e.g., floor-sound effects, multi-effect processors, rack-mounted processors, stompboxes, effect pedals, equalizers, desktop effects and portable effects), preamplifiers, controller pedals, volume pedals, mixers, single or multi-track recorder machines, computers, other musical instruments, a microphone and/or any combination thereof.

Generally, the APDs 170 are adapted to process received audio signals according to an electrical circuit and/or a software algorithm, each of which may employ processing parameters. Importantly, each of the APDs 170 may be configured such that its processing parameters may be set, configured and/or updated via control signals transmitted to the APD.

To that end, each APD 170 is configured to receive control signals 185 from another device (e.g., a control unit 190 and/or another APD 170) via one or more wired or wireless connections. As discussed in detail below in reference to FIG. 2, such control signals 185 may comprise settings information relating to desired values for one or more of the processing parameters associated with the APDs. Accordingly, upon receiving the control signals 185, the APD 170 may update its processing parameters based on the settings information and process the received audio signals according to the updated processing parameters to generate a processed audio signal 195.

As shown, the APDs 170 may be in further communication with one or more audio output devices 180 such that the processed audio signal 195 generated by the APDs is transmitted to the audio output device via a wired or wireless connection. Upon receiving the processed audio signal 195 from the APDs 170, the audio output device(s) 180 may output an output audio signal that may be audible to one or more users.

In one exemplary embodiment, the audio output device 180 may include any number of speakers. It will be appreciated that the audio output device 180 may be integral to an APD 170 or may be external thereto. It will also be appreciated that any number of audio output devices 180 may be employed as required or desired.

As shown, the system 100 may comprise a control unit 190 in communication with various system components via one or more communication protocols. Generally, the control unit 190 may be adapted to: receive audio signals from various devices, receive settings information from various devices, transmit audio signals to APDs, transmit control signals to APDs, and/or send/receive other data to/from various devices.

In one embodiment, the control unit 190 may be employed to pass an input audio signal 192 from an instrument 150 to one or more APDs 170. To that end, the control unit 190 may be in direct communication with the instrument 150 (e.g., via a wired or wireless connection) to receive the input audio signal 192 therefrom. The control unit 190 may also be in direct communication with one or more of the APDs 170 (e.g., via a wired or wireless connection) such that it may transmit the input audio signal thereto.

The type of connection between the instrument 150 and control unit 190 may be the same as the connection between the control unit and the APDs 170. Alternatively, a first type of connection may be employed between the instrument 150 and the control unit 190, and a second type of connection may be employed between the control unit 190 and the APDs 170.

The control unit 190 may also be employed to transmit/receive additional data to/from the APDs 170. Such information may include, but is not limited to, device information relating to each of the APDs present in the system and settings information relating to various processing parameters of such devices. Exemplary device information may include, but is not limited to: device name, unique ID, device serial number, device type, model, status, WAN address, LAN address, firmware version, current processing parameter values, current presets, an array of presets stored in memory and/or others.

Exemplary settings information may include, but is not limited to: a unique identifier associated with an APD, a processing parameter associated with the APD, and a value associated with the parameter (i.e., a "desired value"). In certain embodiments, settings information may comprise an array of processing parameters and associated desired values for a particular APD.

Additionally, settings information may comprise an array of APDs, wherein each APD may itself be associated with an array of processing parameters and associated desired values. In one embodiment, the control unit 190 may transmit control signals containing (or representing) settings information relating to desired values of processing parameters associated with one or more of the APDs 170.

In one embodiment, the control unit 190 may send/receive such information to/from the APDs 170 via the same connection that is employed to transmit the input audio signal. In other embodiments, a separate/additional wired or wireless connection may be employed (e.g., Ethernet, Wi-Fi, Bluetooth, BLE, NFC, RFID, Z-WAVE, ZIGBEE, UNIVERSAL POWERLINE BUS ("UPB"), INSTEON, THREAD, etc.).

It will be appreciated that the control unit 190 may optionally store device information and/or settings information for any number of connected APDs 170 (e.g., via internal or external memory). It will be further appreciated that, in some embodiments, the control unit 190 may display such information to a user (e.g., via an internal or external display).

As shown, the control unit 190 may be further adapted to send/receive device information and settings information to/from various additional system components. In one embodiment, the control unit 190 may communicate with any number of user devices 110 and/or a server 120 via the network 130 (e.g., via Wi-Fi or Ethernet). For example, a user may input settings information into a user device 110; the user device may transmit the settings information over the network 130, to server 120; the server may transmit the settings information over the network, to the control unit 190; and the control unit 190 may transmit the settings information to the various APDs 170.

In another embodiment, the control unit 190 may additionally or alternatively communicate with one or more user devices 110 directly (e.g., via a Bluetooth connection). For example, a user may input settings information into a user device 110; the user device may transmit the settings information to a control unit 190; and the control unit 190 may transmit the settings information to the various APDs 170. In such cases, the user device 110 or the control unit 190 may also transmit the settings information to the server 120 over the network 130.

The server 120 may be adapted to receive, determine, record and/or transmit the device information, settings information and, optionally, user information relating to users of the system (collectively, "application information"). Exemplary user information may include, but is not limited to: user identification information (e.g., unique ID, name, username, password, image, bio, age, gender, etc.); contact information (e.g., email address, mailing address, phone number, etc.); and/or billing information (e.g., credit card information, billing address, etc.).

Generally, a user device 110 may be any device capable of running a client application and/or of accessing the server 120 (e.g., via a network 130) to allow users to view, update, store and/or delete application information. Exemplary user devices 110 may include general-purpose computers, special-purpose computers, desktop computers, laptop computers, smartphones, tablets and/or wearable devices.

It will be appreciated that, in certain embodiments, the functionality of the control unit 190 may be integral to a user device 110. For example, a user may input settings information into the user device 110 and the user device may transmit the settings information to the various APDs 170.

Moreover, the functionality of one or more APDs 170 may also be integral to a user device 110. In such cases, the user device 110 may be configured to receive an audio signal (e.g., from an instrument) and process the signal according to user input. For example, a user may input settings information into the user device 110; the user device may receive an input audio signal from an instrument 150; the user device may process the input audio signal according to the settings information; and the user device may transmit, store and/or output the processed audio signal. It will be appreciated that the user device may also transmit settings information, device information, user information, a received audio signal and/or a processed audio signal to the server 120, over the network 130.

In one embodiment, the system 100 may optionally comprise one or more remote controller units 115 in communication with the control unit 190 via a wired or wireless connection. Like the user device 110, a remote controller unit 115 may allow a user to select or enter settings information relating to one or more processing parameters associated with an APD. However, a remote controller unit 115 differs from a user device 110 in that it does not communicate with the network 130; it communicates directly with the control unit 190.

Exemplary remote controllers 115 may comprise one or more user interface components (e.g., physical or digital knobs, buttons, sliders, etc.) to allow a user to input or select settings information corresponding to a desired value of one or more processing parameters associated with one or more of the APDs. It will be appreciated that such remote controllers may comprise any form factor, including but not limited to, stompboxes, effect pedals, desktop units, joysticks, keyboards, and other portable units that may be worn by a user and/or attached to an instrument.

Finally, the system 100 may include one or more databases 140 and/or one or more third-party systems 135 in communication with the server 120 via the network 130. Third-party systems 135 may store information in one or more databases that may be accessed by the server 120, with or without user interaction. Exemplary third-party systems 135 may include, but are not limited to: payment and billing systems, systems for sharing, selling, purchasing and downloading APD presets, recommendation systems, device information databases, social media and messaging systems, and/or cloud-based storage and backup systems.

Figure 2:
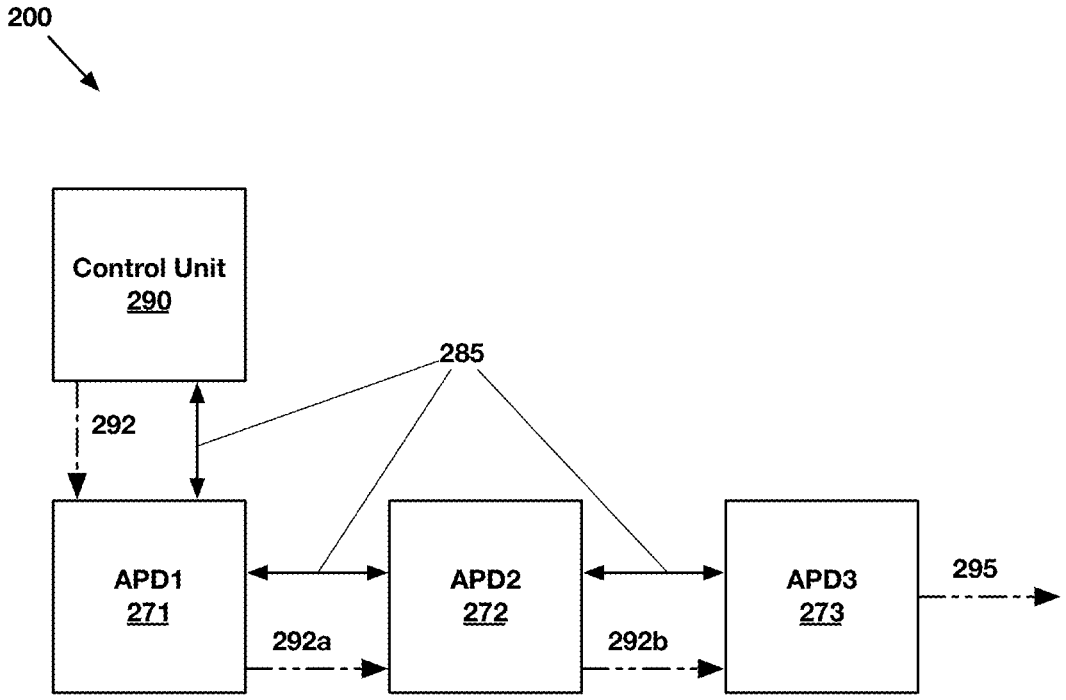
FIG. 2 shows an exemplary system 200 including a control unit 290 in communication with a plurality of APDs 271-273 connected in series.

Referring to FIG. 2, an exemplary system 200 comprising a plurality of APDs 271-273 is illustrated. In one embodiment, any number of APDs (271-273) may be connected in series (e.g., via wired or wireless connections) such that control signals 285 and audio signals 292 may be passed from one APD to the next.

In the illustrated embodiment, a control unit 290 is connected to a first APD 271 such that the control unit may transmit a control signal 285 to the first APD 271. Upon receiving the control signal 285, the first APD 271 determines any relevant settings information contained therein (i.e., desired values for processing parameters associated with the APD 271) and updates its processing parameters accordingly. The first APD 271 then echoes/transmits the control signal 285 to the second APD 272.

Upon receiving the control signal 285 from the first APD 271, the second APD 272 determines any relevant settings information contained therein, updates its processing parameters, and then echoes/transmits the control signal to the third APD 273. Finally, the third APD 273 receives the control signal, determines any relevant settings information contained therein, and then updates its processing parameters as necessary.

In one embodiment, the data in a control signal 285 may be transmitted in a command sequence reflecting that of the physical configuration of the APDs. For example, the control signal may comprise a command sequence configured such that the settings information for the first APD 271 is sent first, the settings information for the second APD 272 is sent second, and the settings information for a third APD 273 is sent third.

In an alternative embodiment, the settings information included in a control signal 285 may be effectively shared among a plurality of connected APDs (271-273). In such cases, the control signal 285 may comprise unique IDs, wherein each unique ID corresponds to one of the APDs. Accordingly, a given APD may determine that particular settings information contained in the control signal 285 is "relevant" when the settings information is associated with the unique ID that corresponds to the given APD.

Like control signals 285, audio signals 292 may also be transmitted across a plurality of APDs (271-273) connected in series. As shown, an input audio signal 292 is transmitted from the control unit 290 to the first APD 271. The first APD 271 processes the input audio signal 292 according to its updated processing parameters to generate a first processed audio signal 292*a* and then transmits the same to the second APD 272. Upon receiving the first processed audio signal 292*a*, the second APD 272 may process the signal according to its updated processing parameters to generate a second processed audio signal 292*b*. The second APD 272 then transmits the second processed audio signal 292*b* to the third APD 273. Finally, the third APD 273 processes the second processed audio signal 292*b* according to its updated processing parameters to generate an output audio signal 295. Such audio signal 295 may be transmitted from the third APD 273 to an audio output device such that it may be outputted.

Figure 3:
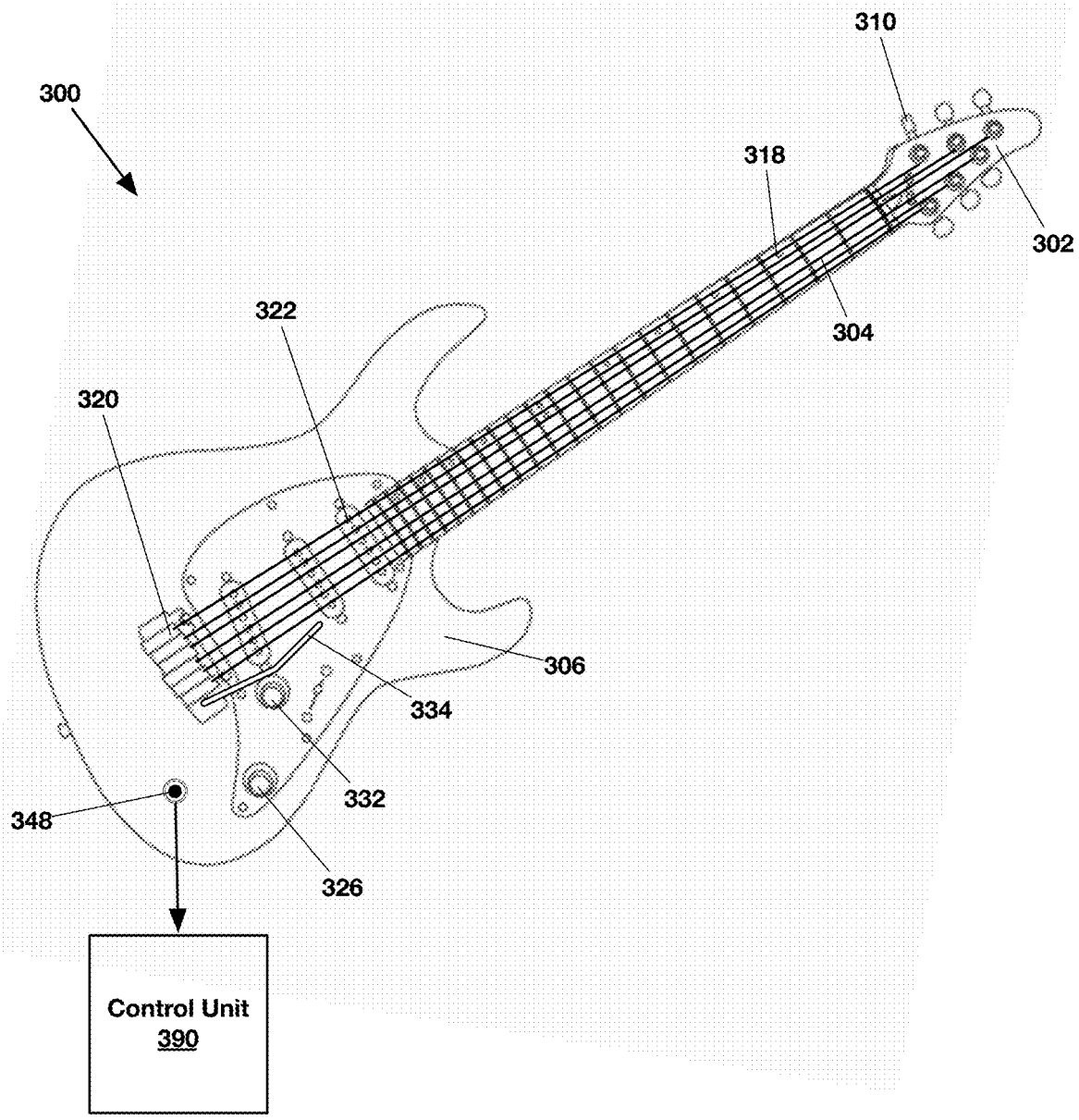
FIG. 3 shows an exemplary instrument 300 according to an embodiment.

Referring to FIG. 3, an exemplary guitar instrument 300 is illustrated. As shown, the guitar 300 includes a number of strings 318, wherein each string extends along a neck 304 of the guitar, from a bridge 320 located on the guitar's body 306 to one of a plurality of tuning pegs 310 located on the guitar's headstock 302. In certain embodiments, the guitar body 306 may also include pickups 322, volume knobs 326, tone knobs 332, a pickup selector switch 334, and an output 348.

Generally, a user may generate a vibration along one or more of the guitar strings 318 by plucking, raking, picking, hammering, tapping, slapping, or strumming ("playing") a string with a first hand while pressing the played string against the neck 304 with a second hand. The strings 318 may extend over one or more pickups 322, which may contain a number of magnets wrapped in wire. It will be appreciated that in other embodiments, the plurality of pickups may comprise piezoelectric material in addition to or instead of magnetic material.

The pickup selector switch 334 may select the pickup 322 or combination of pickups to convert the sound signal. Specifically, the pickup selector switch 334 may electromechanically select a pickup 322 or mix and connect different pickups. The vibrations of one or more of the strings 318 may induce an audio signal in one or more of the wires wrapped around one or more of the pickup 322 magnets. Accordingly, the audio signal may travel along an electric guitar circuit, from one or more of the pickups 322 to an output 348. In one embodiment, the audio signal may then be transmitted from the output 348 a control unit 390, for example via a wired connection.

In one embodiment, the volume and the timbre of the vibration may be manipulated through adjustment of one or more volume knobs 326 and one or more tone knobs 332, respectively. The volume knobs 326 and the tone knobs 332 may adjust variable resistances within the electric guitar 300 to change volume and tone.

Although not shown, in certain embodiments, the guitar 300 may comprise a transmitter adapted to transmit the generated audio signal to a control unit 390 or an external APD. In one embodiment, the functionality of the transmitter may be integrated into the electric guitar 300. In another embodiment, the transmitter may be a standalone device connected to an output 348 of the guitar 300. In such case, the transmitter may be attached to a portion of the guitar 300 via an attachment means, such as a clip, hook, screws, etc.

Figure 4:
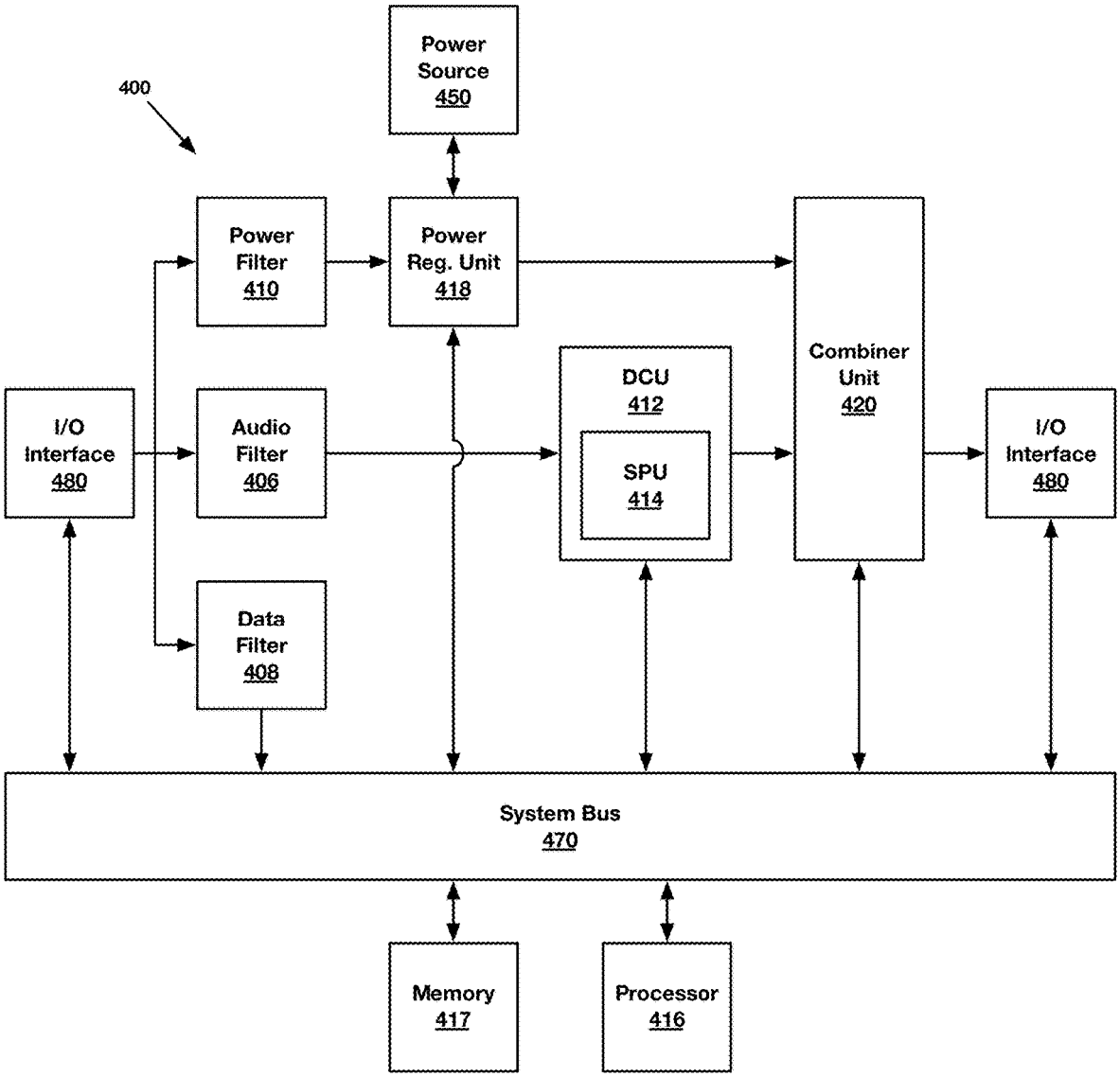
FIG. 4 shows an exemplary APD 400 according to an embodiment.

Referring to FIG. 4, a block diagram of an exemplary audio processing device 400 according to an embodiment is illustrated. As shown, the APD 400 may include an input/output ("I/O") interface 480, one or more filters (406, 408, 410), a digital control unit ("DCU") 412, an audio signal processor unit ("SPU") 414, a processor 416, a power regulation unit 418, a combiner unit 420 and/or memory 417.

The APD 400 may comprise an I/O interface 480 having one or more inputs to receive audio signals, control signals comprising settings information and/or other data. Accordingly, the I/O interface 480 may comprise one or more wired or wireless receivers, such as Wi-Fi receivers, Bluetooth receivers, BLE receivers, NFC receivers, ZIGBEE receivers, Z-WAVE receivers, cellular receivers, IR receivers, RF receivers, microphones, Ethernet ports, USB ports, Apple LIGHTNING ports, stereo ports, etc.

The I/O interface 480 may further comprise one or more outputs to transmit processed audio signals, control signals and/or other data to other devices. Accordingly, the I/O interface 480 may comprise one or more wired or wireless transmitters, such as Wi-Fi transmitters, Bluetooth transmitters, BLE transmitters, NFC transmitters, ZIGBEE transmitters, Z-WAVE transmitters, cellular transmitters, IR transmitters, RF transmitters, Ethernet ports, USB ports, Apple LIGHTNING ports, stereo ports, etc.

As shown, the APD 400 may include a processor 416 in communication with a DCU 412, and a memory 417 (e.g., via a system bus 470). The processor 416 may comprise device firmware and may logically control the functionalities of the APD 400. In one embodiment, the I/O interface 480 may facilitate signal flow between the processor 416 and external sensors and switches. Although not shown, the APD 400 may also include one or more analog/digital converters ("ADCs") to convert incoming analog signals into digital values, and one or more digital/analog converters ("DACs") to convert digital values into output analog signals.

The processor 416 may be connected to the other elements of the APD 400, or the various peripherals discussed herein, through a system bus 470. It should be appreciated that the system bus 470 may be within the processor 416, outside the processor, or both. According to some embodiments, any of the processor 416, the other elements of the APD, or the various peripherals discussed herein may be integrated into a single device such as a system on chip ("SOC"), system on package ("SOP"), or ASIC device.

In one embodiment, the APD 400 may receive a control signal comprising settings information from an external device, such as a control unit and/or another APD. Upon receiving the control signal, the processor 416 may sample, convert, modulate, condition, and/or generate a plurality of control signals based on the settings information contained in the received control signals. The processor 416 may then transmit the generated control signals to the DCU 412 (e.g., via a one-wire protocol, a two-wire protocol, a Recommended Standard number 232 ("RS232") protocol, a Serial Peripheral Interface ("SPI") protocol, an Inter-integrated circuit ("I2C") protocol, a microwire protocol, etc.). The processor 416 may store received control signals and/or generated control signals in memory 417 for future retrieval. And the processor 416 may cause any of such information to be transmitted to another APD via the I/O interface 480.

Generally, the DCU 412 may be adapted to configure, modify and/or update processing parameters employed by a digital or analog SPU according to the control signals received from the processor 416. In one embodiment the DCU 412 may comprise a digital potentiometer that may directly influence processing parameters of an analog SPU 414. For example, the DCU 412 may adjust resistance of the potentiometer by using control signals to manipulate switches in a string of resistors in series. As such, the DCU 412 may provide variable resistance to set values for any number of processing parameters (e.g., tone, output volume, gain, speed, depth, rate control, etc.) employed by the SPU 414 to process received audio signals in analog format.

In another embodiment, the DCU 412 may include, or otherwise be in communication with, one or more ADCs and DACs such that received audio signals may be processed by a digital SPU 414 in digital format (i.e., according to stored processing parameters). In such embodiments, the DAC 412 may update the values of one or more processing parameters of the SPU 414 according to received control signals, convert the received audio signal from analog to digital format, and store the digital audio signal (e.g., in memory 417). The SPU 414 may then process the stored digital audio signal according to the updated processing parameters. And, finally, the processed digital audio signal may be converted back to analog form for transmission to another APD and/or an audio output device (e.g., via output 422).

In one embodiment, the APD 400 may optionally comprise a combiner unit 420 to receive and combine multiple signals for transmission to another device (e.g., an APD or an audio output device) via the I/O interface 480. The various signals may include, for example, a processed audio signal from the SPU 414, a control signal from the processor 416 and/or one or more signals from a power regulation unit 418 (e.g., power, voltage, and/or current signals). Alternatively, a combiner unit 420 may not be included and each of the above signals may be maintained and/or transmitted separately.

As shown, the APD 400 may optionally comprise one or more filters (406, 408, 410) to isolate, remove, pass, amplify, and/or otherwise modulate signal components. Such filters may be analog or digital in nature and may comprise low-pass, high-pass, bandpass, or all-pass filters. In one embodiment, the APD 400 may comprise one or more audio filters 406, data filters 408 and/or power filters 410 to modulate audio signals, control signals, and power signals, respectively.

A power regulation unit 418 may be responsible for delivering power to all of the hardware units present in the APD 400. In certain embodiments, the power regulation unit 418 may comprise a removable and/or rechargeable power source 450, such as a rechargeable battery. In other embodiments, the power source 450 may comprise a transformer either integrated within the APD or connected thereto.

Although not shown, exemplary APDs may comprise a user interface unit adapted to display device information about received audio signals and/or current processing parameter values that are to be applied to such signals. In one embodiment, the user interface unit may comprise one or more user interface components (e.g., knobs, buttons, sliders, touchscreens, etc.) to allow a user to input settings information relating to one or more processing parameters of the APD. In certain embodiments, the user interface unit may be in communication with the APD 400 via the I/O interface 480.

Figure 5:
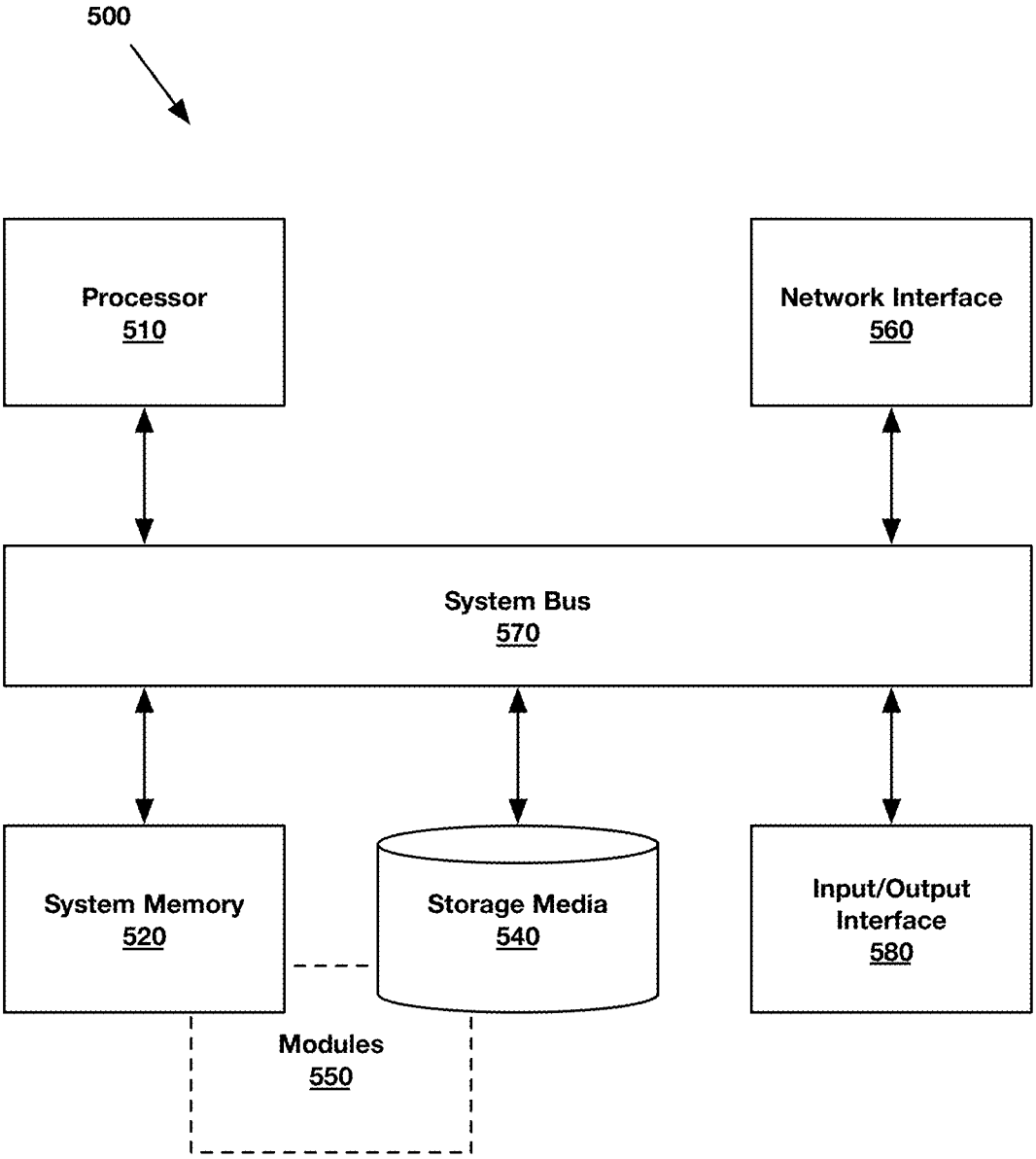
FIG. 5 shows an exemplary computing machine 500 according to an embodiment.

Referring to FIG. 5, an exemplary computing machine 500 comprising modules 550 is illustrated. The computing machine 500 may correspond to any of the various components, computing systems or embedded systems presented herein (e.g., control unit 190, APD 170, remote controller 115, user device 110, and/or server 120 shown in FIG. 1). The modules 550 may comprise one or more hardware or software elements configured to facilitate the computing machine 500 in performing the various methods and processing functions presented herein.

The computing machine 500 may comprise all kinds of apparatuses, devices, and machines for processing data, including but not limited to, a programmable processor, a computer, and/or multiple processors or computers. As shown, an exemplary computing machine 500 may include various internal and/or attached components, such as a processor 510, system bus 570, system memory 520, storage media 540, input/output interface 580, and network interface 560 for communicating with a network.

The computing machine 500 may be implemented as a conventional computer system, an embedded controller, a laptop, a server, a mobile device, a smartphone, a tablet, one or more processors, a customized machine, an instrument, any other hardware platform and/or combinations thereof. Moreover, a computing machine may be embedded in another device. In some embodiments, the computing machine 500 may be a distributed system configured to function using multiple computing machines interconnected via a data network or system bus 570.

The processor 510 may be configured to execute code or instructions to perform the operations and functionality described herein, manage request flow and address mappings, and to perform calculations and generate commands. The processor 510 may be configured to monitor and control the operation of the components in the computing machine 500. The processor 510 may be a general-purpose processor, a processor core, a multiprocessor, a reconfigurable processor, a microcontroller, a digital signal processor ("DSP"), an application specific integrated circuit ("ASIC"), a graphics processing unit ("GPU"), a field programmable gate array ("FPGA"), a programmable logic device ("PLD"), a controller, a state machine, gated logic, discrete hardware components, any other processing unit, or any combination or multiplicity thereof. The processor 510 may be a single processing unit, multiple processing units, a single processing core, multiple processing cores, special purpose processing cores, coprocessors, or any combination thereof. In addition to hardware, exemplary apparatuses may comprise code that creates an execution environment for the computer program (e.g., code that constitutes one or more of: processor firmware, a protocol stack, a database management system, an operating system, and a combination thereof). According to certain embodiments, the processor 510 and/or other components of the computing machine 500 may be a virtualized computing machine executing within one or more other computing machines.

The system memory 520 may include non-volatile memories such as read-only memory ("ROM"), programmable read-only memory ("PROM"), erasable programmable read-only memory ("EPROM"), flash memory, or any other device capable of storing program instructions or data with or without applied power. The system memory 520 also may include volatile memories, such as random-access memory ("RAM"), static random-access memory ("SRAM"), dynamic random-access memory ("DRAM"), and synchronous dynamic random-access memory ("SDRAM"). Other types of RAM also may be used to implement the system memory. The system memory 520 may be implemented using a single memory module or multiple memory modules. While the system memory is depicted as being part of the computing machine 500, one skilled in the art will recognize that the system memory may be separate from the computing machine without departing from the scope of the subject technology. It should also be appreciated that the system memory may include, or operate in conjunction with, a non-volatile storage device such as the storage media 540.

The storage media 540 may include a hard disk, a compact disc read only memory ("CD-ROM"), a digital versatile disc ("DVD"), a Blu-ray disc, a magnetic tape, a flash memory, other non-volatile memory device, a solid-state drive ("SSD"), any magnetic storage device, any optical storage device, any electrical storage device, any semiconductor storage device, any physical-based storage device, any other data storage device, or any combination or multiplicity thereof.

The storage media 540 may store one or more operating systems, application programs and program modules such as modules 550. In one embodiment, the storage media 540 may store various application information, such as user information, settings information relating to processing parameters of any number of APDs, and/or device information relating to any of such APDs (or other system components). The storage media may be part of, or connected to, the computing machine 500. The storage media may also be part of one or more other computing machines that are in communication with the computing machine such as servers, database servers, cloud storage, network attached storage, and so forth.

The modules 550 may comprise one or more hardware or software elements configured to facilitate the computing machine 500 with performing the various methods and processing functions presented herein. The modules 550 may include one or more sequences of instructions stored as software or firmware in association with the system memory 520, the storage media 540, or both. The storage media 540 may therefore represent examples of machine or computer readable media on which instructions or code may be stored for execution by the processor. Machine or computer readable media may generally refer to any medium or media used to provide instructions to the processor. Such machine or computer readable media associated with the modules may comprise a computer software product. It should be appreciated that a computer software product comprising the modules may also be associated with one or more processes or methods for delivering the module to the computing machine via the network, any signal-bearing medium, or any other communication or delivery technology. The modules 550 may also comprise hardware circuits or information for configuring hardware circuits such as microcode or configuration information for an FPGA or other PLD.

The I/O interface 580 may be configured to couple to one or more external devices, to receive data from the one or more external devices, and to send data to the one or more external devices. Such external devices along with the various internal devices may also be known as peripheral devices. The I/O interface 580 may include both electrical and physical connections for operably coupling the various peripheral devices to the computing machine 500 or the processor 510. The I/O interface 580 may be configured to communicate data, addresses, and control signals between the peripheral devices, the computing machine, or the processor. The I/O interface 580 may be configured to implement any standard interface, such as small computer system interface ("SCSI"), serial-attached SCSI ("SAS"), fiber channel, peripheral component interconnect ("PCI"), PCI express (PCIe), serial bus, parallel bus, advanced technology attachment ("ATA"), serial ATA ("SATA"), USB, Thunderbolt, FireWire, various audio buses, and the like. The I/O interface may be configured to implement only one interface or bus technology. Alternatively, the I/O interface may be configured to implement multiple interfaces or bus technologies. The I/O interface may be configured as part of, all of, or to operate in conjunction with, the system bus 570. The I/O interface 580 may include one or more buffers for buffering transmissions between one or more external devices, internal devices, the computing machine 500, or the processor 510.

The I/O interface 580 may couple the computing machine 500 to various input devices including mice, touchscreens, scanners, biometric readers, electronic digitizers, sensors, receivers, touchpads, trackballs, cameras, microphones, keyboards, any other pointing devices, or any combinations thereof. When coupled to the computing device, such input devices may receive input from a user in any form, including acoustic, speech, visual, or tactile input.

The I/O interface 580 may couple the computing machine 500 to various output devices such that feedback may be provided to a user via any form of sensory feedback (e.g., visual feedback, auditory feedback, or tactile feedback). For example, a computing device can interact with a user by sending documents to and receiving documents from a device that is used by the user (e.g., by sending web pages to a web browser on a user device in response to requests received from the web browser). Exemplary output devices may include, but are not limited to, displays, speakers, printers, projectors, tactile feedback devices, automation control, robotic components, actuators, motors, fans, solenoids, valves, pumps, transmitters, signal emitters, lights, and so forth. And exemplary displays include, but are not limited to, one or more of: projectors, cathode ray tube ("CRT") monitors, liquid crystal displays ("LCD"), light-emitting diode ("LED") monitors and/or organic light-emitting diode ("OLED") monitors.

Embodiments of the subject matter described in this specification can be implemented in a computing machine 500 that includes one or more of the following components: a backend component (e.g., a data server); a middleware component (e.g., an application server); a frontend component (e.g., a client computer having a graphical user interface ("GUI") and/or a web browser through which a user can interact with an implementation of the subject matter described in this specification); and/or combinations thereof. The components of the system can be interconnected by any form or medium of digital data communication, such as but not limited to, a communication network.

Accordingly, the computing machine 500 may operate in a networked environment using logical connections through the network interface 560 to one or more other systems or computing machines across a network. The network may include WANs, LANs, intranets, the Internet, wireless access networks, wired networks, mobile networks, telephone networks, optical networks, or combinations thereof. The network may be packet switched, circuit switched, of any topology, and may use any communication protocol. Communication links within the network may involve various digital or an analog communication media such as fiber optic cables, free-space optics, waveguides, electrical conductors, wireless links, antennas, radio-frequency communications, and so forth.

The processor 510 may be connected to the other elements of the computing machine 500 or the various peripherals discussed herein through the system bus 570. It should be appreciated that the system bus 570 may be within the processor, outside the processor, or both. According to some embodiments, any of the processor 510, the other elements of the computing machine 500, or the various peripherals discussed herein may be integrated into a single device.

Referring to FIGS. 6-9, exemplary user interface screens (600, 700, 800, 900) of a client application are illustrated. In one embodiment, a client application can be deployed on and/or accessed by one or more user devices. For example, a user may download a client application to a user device or may navigate to a web-based client application using an internet browser running on the user device.

Upon accessing the client application, a user may create a new account and/or login to an existing account. In some embodiments, account creation and/or login activities may implement a third-party identity or authentication service to verify the identity of a user (e.g., FACEBOOK, GOOGLE, LINKEDIN and/or TWITTER).

In certain embodiments, the client application may display various interface screens to receive application information from the user and to assist the user in configuring the system. For example, the application may display input fields to collect user information, such as a name, age, email address, billing information, and/or other information. As another example, the client application may display instructions to allow a user to connect one or more APDs or remote controllers to the user's account.

Generally, the system may employ APD-specific digital models to communicate with various APDs and to allow users to view/control information associated with such devices via the client application. Such models may comprise APD-specific information relating to available processing parameters, values of such parameters and/or means of communicating with the APD to adjust such parameters. The models may further comprise APD-specific digital interface elements that may be displayed via the client application. As explained below, such interface elements may display device information and/or may provide various controls to allow users to adjust APD processing parameter values.

Figure 6:
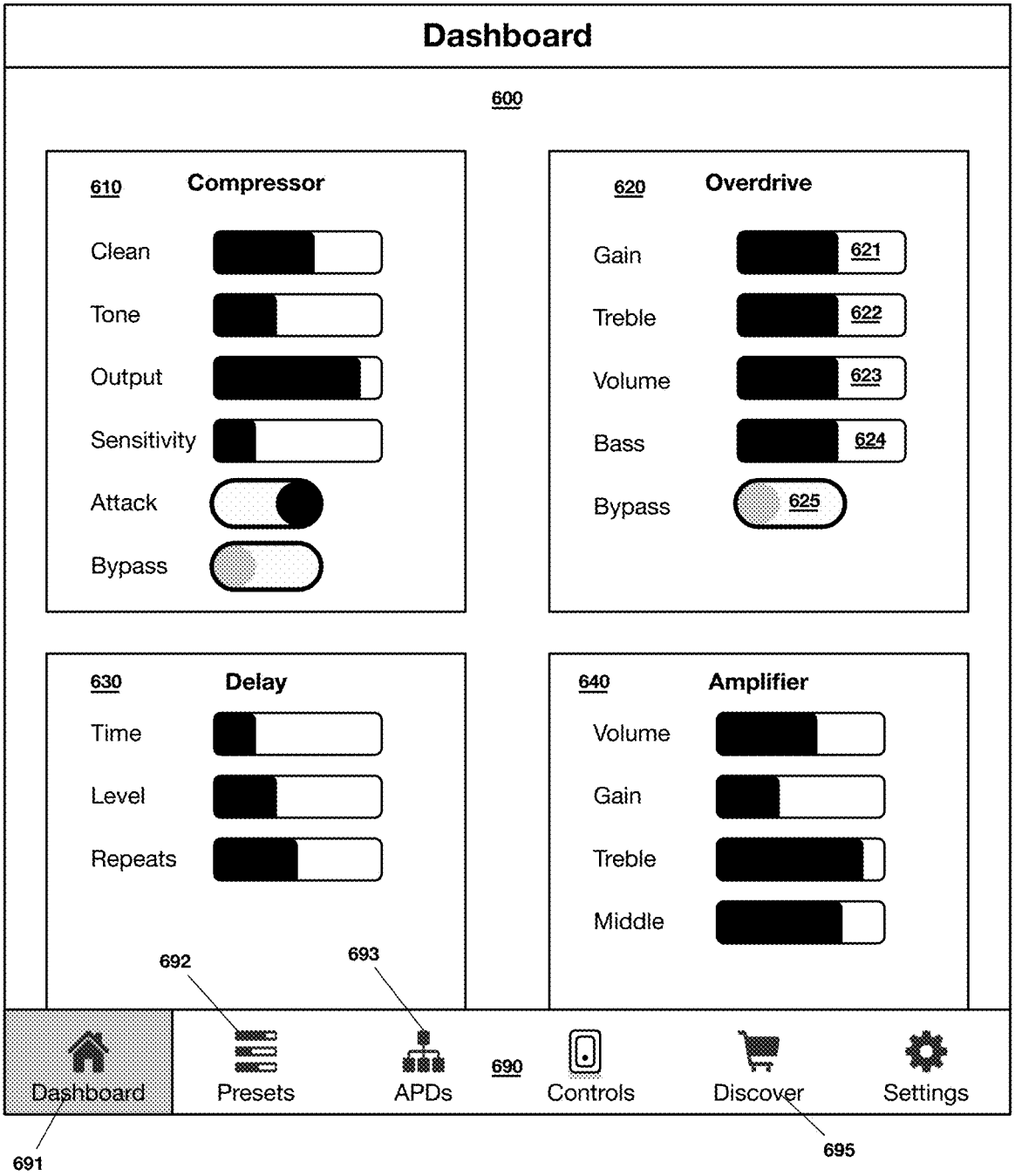
FIG. 6 shows an exemplary dashboard screen 600 of a client application according to an embodiment.

Referring to FIG. 6, an exemplary dashboard screen 600 of a client application is illustrated. As shown, the dashboard screen 600 may display one or more control panels (610, 620, 630, 640), wherein each panel corresponds to an APD associated with the user's account.

The control panels (e.g., 620) may comprise various interface elements (621-625) to allow users to view and adjust values of processing parameters associated with a given APD. For example, control panel 620 corresponds to an overdrive APD and includes interface elements to allow a user to input or select values of the following processing parameters: gain 621, treble 622, volume 623 and bass 624. In one embodiment, a bypass 625 interface element may also be provided to allow a user to bypass a given APD. It will be appreciated that such processing parameters are merely exemplary and the system may determine, display and adjust values for any processing parameter associated with an APD.

Generally, the user may input a desired value for a particular APD processing parameter via the corresponding interface element (621-624) and the system may transmit such information (e.g., via a control signal) to the APD. Upon receiving the control signal, the APD will adjust the value of the processing parameter from a current value to the desired value. In some embodiments, the APD may then transmit the updated current value (which should correspond to the desired value) to the system such that it may be displayed to the user via the client application.

In certain embodiments, the dashboard screen 600 may display a navigation menu 690 comprising links to various additional screens of the client application. As shown, the navigation menu 690 may include a link 691 to the dashboard screen 600, a link 692 to a presets list screen (e.g. FIG. 7 at 700), and/or a link 693 to an APDs information screen (e.g., FIG. 9 at 900).

In one embodiment, the navigation menu 690 may further include a link 695 to an online marketplace or store where users can browse, purchase and/or download in-app content, such as preconfigured APD models and/or presets. The marketplace may be external to the application (e.g., GOOGLE PLAY STORE, APPLE APP STORE, etc.) or may be internal thereto. And the content made available through the online store may be created, uploaded, maintained, sponsored and/or removed by any number of corporate or individual users.

Figure 7:
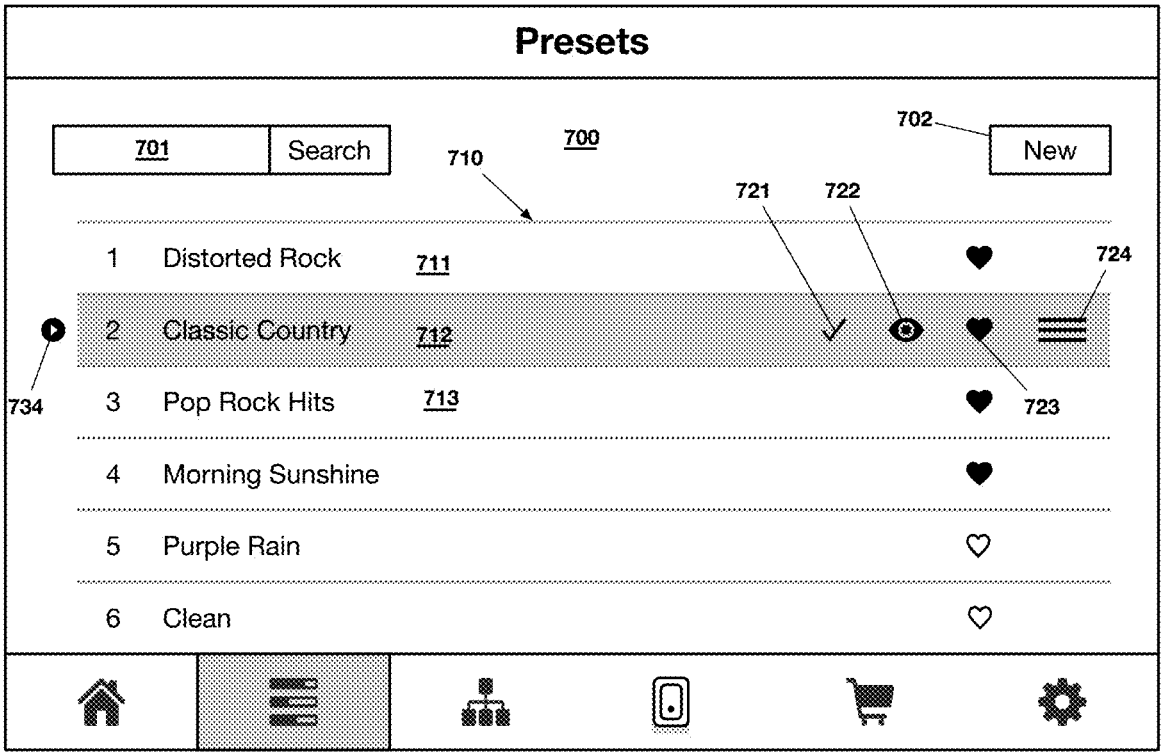
FIG. 7 shows an exemplary presets list screen 700 of a client application according to an embodiment.

Referring to FIG. 7, an exemplary presets list screen 700 of a client application is illustrated. Generally, the system may allow users to create, store and apply presets to automatically adjust a plurality of processing parameter values for one APD or across many APDs.

In one embodiment, the screen 700 may display a presets list 710 comprising any number of presets (711-713) associated with the user's account. As shown, a user may select one of the displayed presets (e.g, preset 712) to view additional options, such as: an option 721 to apply the selected preset, an option 722 to view and/or edit details of the selected preset, an option 723 to add the selected preset to a favorites list (or another list) and/or an option 724 to move the selected preset to a different position in the list 710.

In certain embodiments, the presets list screen 700 may include various additional functionality. For example, the screen 700 may display an option 702 to allow a user to create a new preset. As another example, the screen may provide search functionality 701 to allow a user to search or filter the presets list 710 according to search parameters. And as another example, the screen may display a status indicator 734 to indicate which preset 712 is currently in use by the system.

Figure 8:
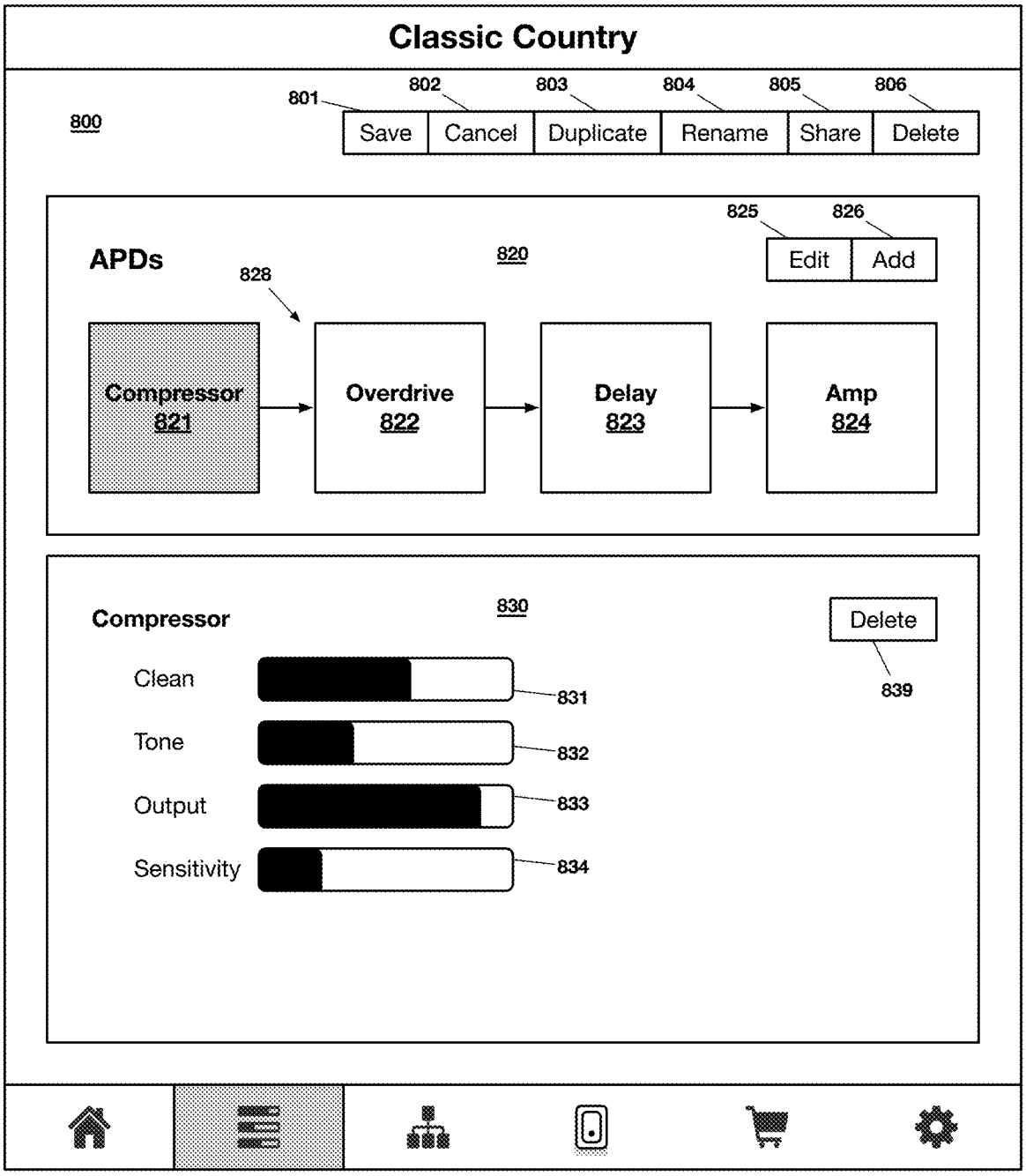
FIG. 8 shows an exemplary preset details screen 800 of a client application according to an embodiment.

Referring to FIG. 8, an exemplary preset details screen 800 of a client application is illustrated. As shown, this screen 800 may display various information and options relating to a given preset (e.g., the "Classic Country" preset 712 selected via option 722 in FIG. 7).

In one embodiment, the preset details screen 800 may display an APDs configuration panel 820 showing the one or more APDs (821-824) associated with the selected preset. The panel 820 may display a graphical representation of how the APDs (821-824) are connected to one another to process audio signals (i.e., a signal chain 828). As shown, the user may add 826 an APD to the signal chain 828. The user may also edit 825 or reorder one or more connections between APDs in the signal chain 828. It will be appreciated that, in certain embodiments, the system may employ information relating to the signal chain 828 to determine and/or adjust various characteristics of control signals (e.g., signal sequence and/or timing).

In one embodiment, the screen 800 may comprise an APD settings panel 830 configured to display interface elements (831-834) for a selected APD 821. As discussed above, interface elements (831-834) allow the user to input desired values for various processing parameters of the selected APD 821. In one particular embodiment, the APD settings panel 830 may also display a delete option 830 to allow the user to completely remove the selected APD from the preset.

In certain embodiments, the preset details screen 800 may display various options to allow the user to save 801 or cancel 802 any changes made to the preset. The system may also display options to allow the user to duplicate 803, rename 804, and/or delete 806 the selected preset.

Finally, in one embodiment, this screen 800 may include a share option 805 to allow a user to share the selected preset with others. Presets may be shared via an online marketplace, as discussed above. Additionally or alternatively, presets may be shared via one or more social media platforms (e.g., Facebook, Instagram, Twitter, Google, etc.) and/or various messaging applications (e.g., email, SMS, WhatsApp, GroupMe, etc.).

Figure 9:
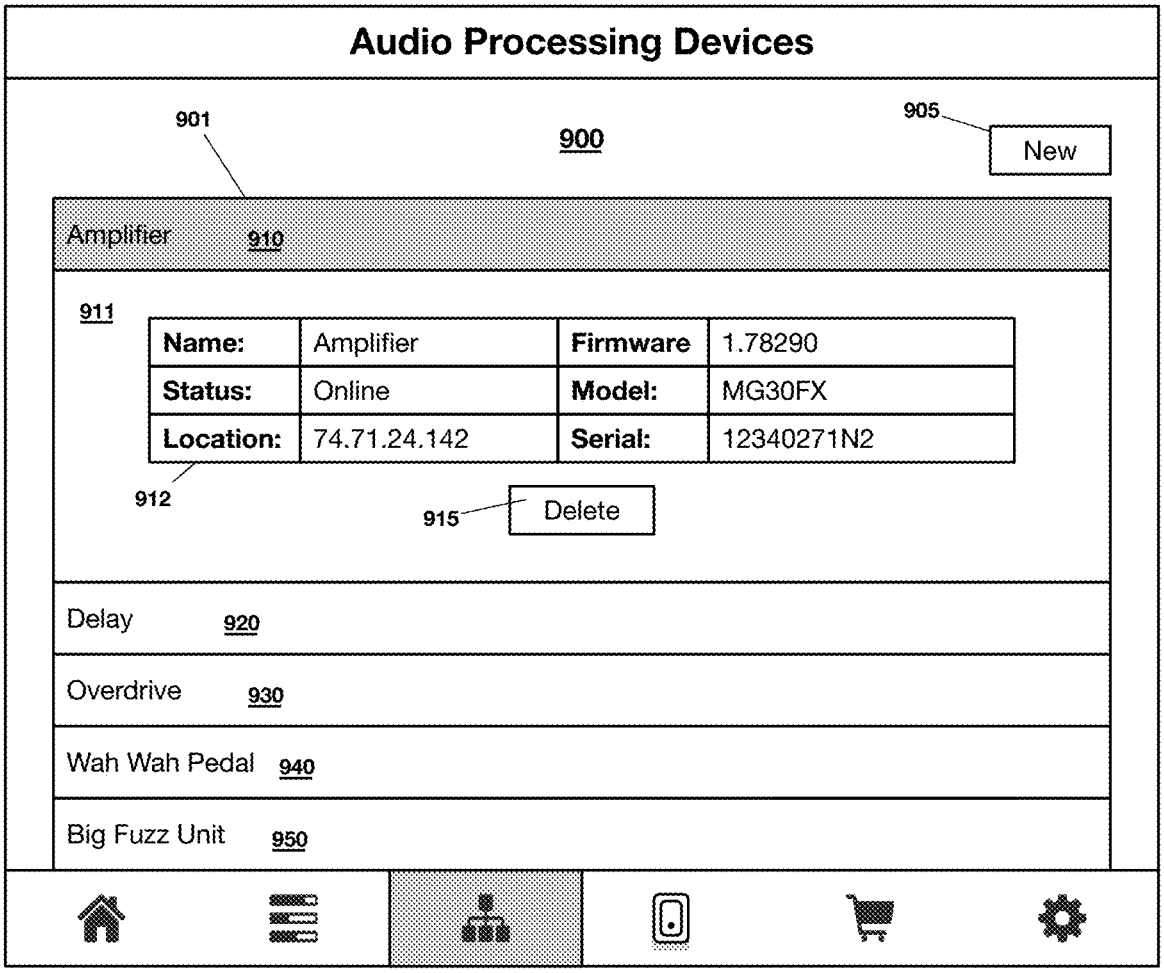
FIG. 9 shows an exemplary APDs information screen 900 of a client application according to an embodiment.

Referring to FIG. 9, an exemplary APDs information screen 900 of a client application is illustrated. As shown, this screen may display a list 901 comprising each of the APDs (910, 920, 930, 940, 950) associated with a user's account.

Upon selecting one of the listed APDs (e.g., APD 910), a corresponding APD details panel 911 may be displayed. As shown, the panel 911 may include various device information 912 associated with the selected APD 910, such as the device's name, status information, LAN or WAN IP address, unique ID, firmware model, model number and/or serial number. Exemplary status information may indicate that an APD is connected, disconnected, ready, in-use, and/or any information relating to a battery level of the APD. The APD details panel 911 may also include an option 915 to delete a selected APD 910 from the user's account.

In one embodiment, the APDs information screen 900 may display an option 905 to add a new APD to the user's account. Upon selecting the option 905, the system may search for available, unconfigured devices. When such a device is discovered, the system may establish a data connection with the device, receive device information from the device, determine an APD model that corresponds to the device, and associate the device with the user's account. The APD (i.e., the APD model corresponding to the newly added device) may then be displayed to the user (e.g., via the APDs information screen 900 and/or the dashboard screen 600) along with any corresponding device information and/or settings information received from the device.

Figure 10:
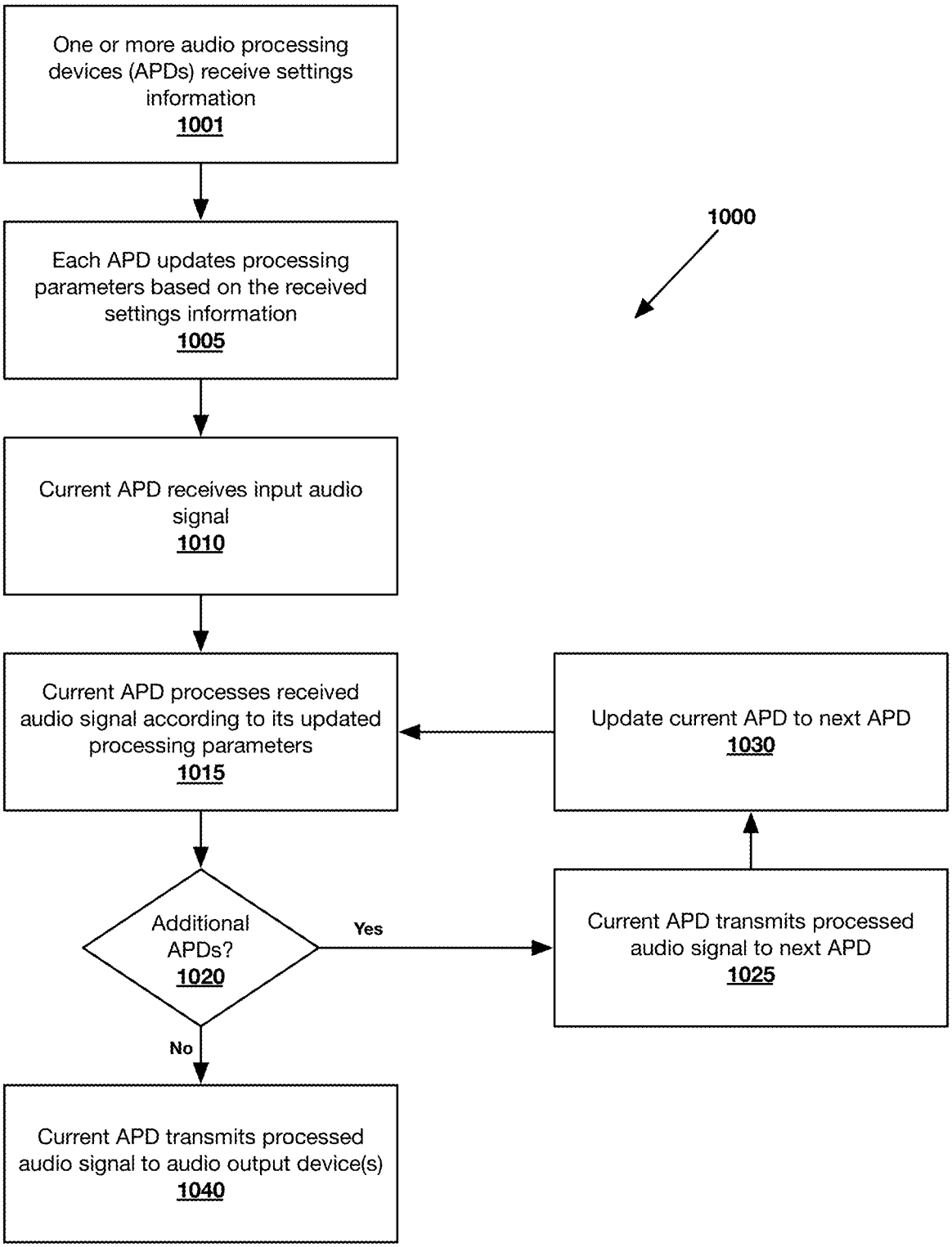
FIG. 10 shows an exemplary method 1000 of processing an input audio signal via one or more connected APDs according to an embodiment.

Referring to FIG. 10, an exemplary method 1000 for controlling processing parameters of one or more APDs is illustrated. As shown, the method may begin at step 1001, where one or more APDs receive settings information. In one embodiment, the settings information may be received in the form of a control signal transmitted by a control unit via a wired or wireless connection.

At step 1005, one or more of the APDs may each update values associated with one or more of their processing parameters, as necessary, based on the received settings information. As an example, a first APD may update a value of a first processing parameter to match a desired first value indicated by the settings information. The first APD may also update a value of a second processing parameter to match a desired second value indicated by the settings information. Additionally, a second APD may also update a value of one of its processing parameters (i.e., a third processing parameter) to match a desired third value indicated by the settings information. Upon the conclusion of step 1005, each APD may be associated with updated processing parameters.

At step 1010, a first APD (i.e., a "current" APD) receives an input audio signal. As discussed above, the first APD may receive the input audio signal from a control unit connected to an instrument. Alternatively, the first APD may receive the input audio signal directly from the instrument or via an intermediate unit.

At step 1015, the current APD processes the received audio signal according to its updated processing parameters to generate a processed audio signal. If no additional APDs are present in the signal chain 1020, the current APD simply transmits the processed audio signal to an integrated or external audio output device (e.g., one or more speakers) at step 1040. Otherwise, the method continues to step 1025 where the next APD receives the processed audio signal from the current APD. The current APD is then set to the next APD at step 1030, and the method returns to step 1015. Accordingly, steps 1015, 1020, 1025 and 1030 may be repeated as necessary until all APDs have received and processed the audio signal.

Figure 11:
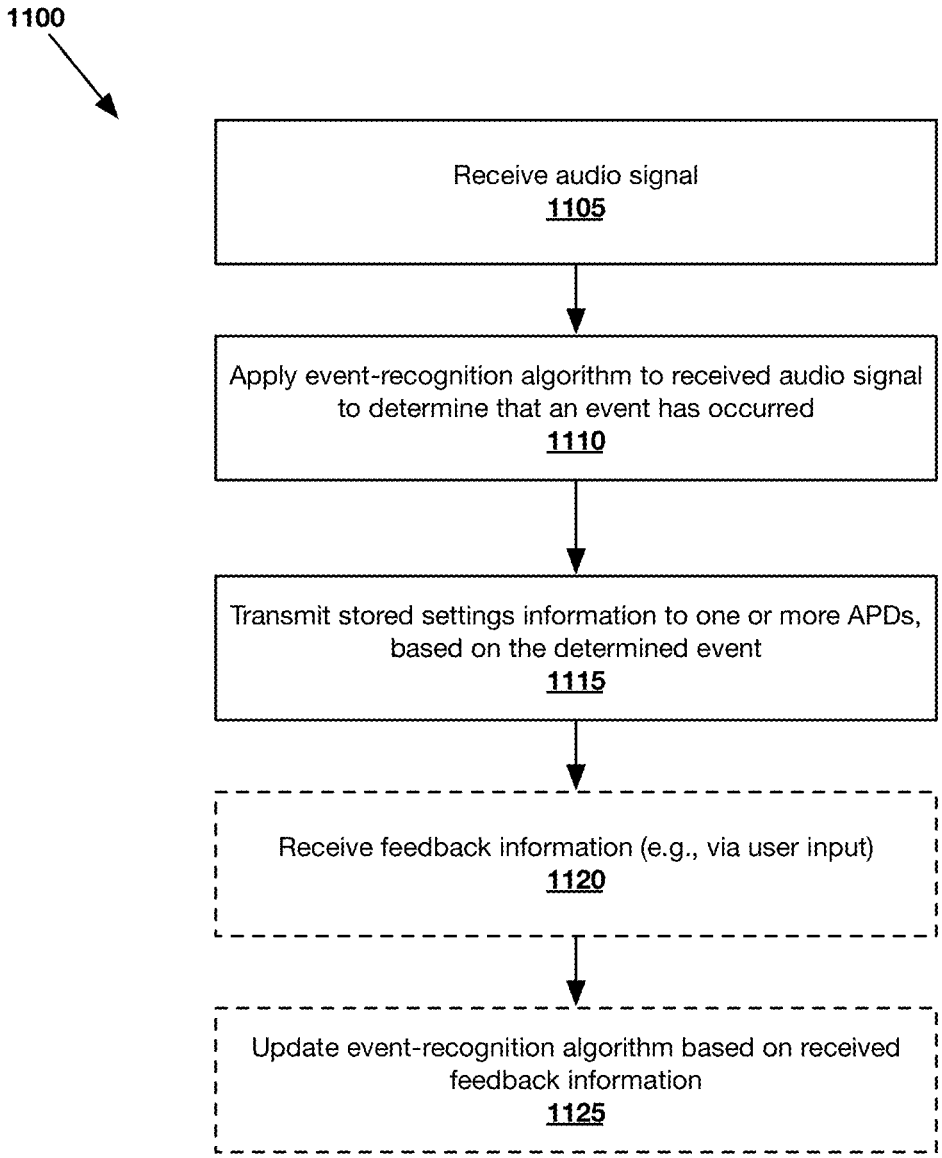
FIG. 11 shows an exemplary method 1100 of automatically controlling one or more APDs according to an embodiment.

Referring to FIG. 11, an exemplary method 1100 for automatically controlling one or more APDs is illustrated. In certain embodiments, the system may be configured to automatically determine the occurrence of certain events in order to apply specific, stored settings information (e.g., presets) to connected APDs.

As shown, the method begins at step 1105, where the system receives an input audio signal generated by an instrument. In such cases, a user device may be in direct or indirect communication with the instrument or a control unit such that the input audio signal produced by the instrument is received by the user device. As an example, the user device may receive an input audio signal directly from an instrument via an internal or external input transducer, such as a microphone. As another example, the user device may receive the input audio signals via a wired or wireless connection to the instrument (e.g., Bluetooth, stereo cable, USB cable, Apple LIGHTNING cable, etc.).

It will be appreciated that such transmitting functionality may be integral to the instrument or may require a standalone transmitter device connected thereto. It will also be appreciated that, whether or not a transmitter is employed, the input audio signal may be transmitted from the instrument to both a user device and a control unit. Alternatively, the user device may indirectly receive the input audio signal generated by the instrument via the control unit.

At step 1110, the system applies one or more event-recognition algorithms to the received audio signal to determine that an event has occurred. Generally, the event-recognition algorithms employed by the system may be based on various factors, including but not limited to: an instrument, a specific musical compositions (i.e., a song), a part of a song, a genre of a song, a transition from one part of a song to another, a transition from one song to another, a user, a connected APD, a combination or sequence of APDs, and/or various combinations thereof.

As an example, the system may determine when a particular song is being played by a particular instrument. As another example, the system may determine when a particular part of a particular song is being played by a particular instrument. And, as yet another example, the system may determine when a musician transitions from a first part of a song to a second part.

In one embodiment, the system may comprise machine learning and/or artificial intelligence capabilities to determine events. For example, system may comprise a machine learning engine that employs artificial neural networks to model and classify received audio signals.

At step 1115, the system transmits stored settings information (e.g., a preset) to one or more APDs based on the determined event. It will be appreciated that any stored settings information may be associated with one or more events. Accordingly, when a specific event is detected, the system may transmit the settings information that is associated with the detected event.

In certain embodiments, the system may display a notification to a user when an event is detected. The notification may include any information about the detected event, the audio signal and/or the associated settings information to be applied to the APDs. In such cases, the system may wait for user confirmation before transmitting the settings information to the APDs. Accordingly, if the user rejects the suggested settings, the system will not transmit such information to the APDs.

At step optional step 1120, the system may receive feedback information (e.g., a modification of a setting, a rejection of a recommendation, a rating of a recommendation, etc.) from the user (e.g., via the user device). Finally, at optional step 1125, the system may update the event-recognition algorithm(s) based on any feedback information received in the previous step.

In certain embodiments, the system may additionally or alternatively automatically determine and/or recommend a specific connection sequence (i.e., signal chain) of APDs to the user based on one or more factors, including: the input audio signal, one or more selected APDs, a selected band, a selected song, a selected genre, historical APD settings determined by/for the user (e.g., for a song, a portion of a song, a genre of a song, instrument, band), historical APD sequences determined for other users (e.g., users with similar audio preferences, users with the same APDs, users with the same instruments, users who have played the same or similar songs, etc.), popular sequences of the same APDs, etc.

Various embodiments are described in this specification, with reference to the detailed discussed above, the accompanying drawings, and the claims. Numerous specific details are described to provide a thorough understanding of various embodiments. However, in certain instances, well-known or conventional details are not described in order to provide a concise discussion. The figures are not necessarily to scale, and some features may be exaggerated or minimized to show details of particular components. Therefore, specific structural and functional details disclosed herein are not to be interpreted as limiting, but merely as a basis for the claims and as a representative basis for teaching one skilled in the art to variously employ the embodiments.

The embodiments described and claimed herein and drawings are illustrative and are not to be construed as limiting the embodiments. The subject matter of this specification is not to be limited in scope by the specific examples, as these examples are intended as illustrations of several aspects of the embodiments. Any equivalent examples are intended to be within the scope of the specification. Indeed, various modifications of the disclosed embodiments in addition to those shown and described herein will become apparent to those skilled in the art, and such modifications are also intended to fall within the scope of the appended claims.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

All references including patents, patent applications and publications cited herein are incorporated herein by reference in their entirety and for all purposes to the same extent as if each individual publication or patent or patent application was specifically and individually indicated to be incorporated by reference in its entirety for all purposes.

What is claimed is:

1. A method comprising:

storing, by a control unit, a preset associated with settings information comprising:

a first value relating to a first processing parameter of a first audio processing device ("APD"); and a second value relating to a second processing parameter of the first APD;

receiving, by the control unit, an indication that a user has selected the preset;

upon said receiving the indication, generating, by the control unit, a control signal comprising the settings information;

transmitting, by the control unit, the control signal to one or more APDs in communication with the control unit, wherein the one or more APDs comprises the first APD, and wherein the control signal causes the first APD to:

update the first processing parameter to the first value, and update the second processing parameter to the second value; and receiving, by the control unit, from the first APD, device information comprising a first current value of the first processing parameter and a second current value of the second processing parameter, wherein the first current value is equal to the first value, and wherein the second current value is equal to the second value.

2. A method according to claim 1, further comprising:

receiving, by the control unit, an input audio signal; and transmitting, by the control unit, the input audio signal to the first APD to thereby cause the first APD to processes the input audio signal to a first processed audio signal based on the updated first processing parameter and the updated second processing parameter.

3. A method according to claim 2, wherein the input audio signal is received from an instrument in communication with the control unit.

4. A method according to claim 1, wherein the indication is received from a user device in communication with the control unit.

5. A method according to claim 4, wherein the control unit is in communication with the user device via a network.

6. A method according to claim 1, wherein the indication is received from a remote controller in communication with the control unit.

7. A method according to claim 1, wherein the device information further comprises one or more of: a name, a model, a status, an IP address, a serial number, and a unique ID.

8. A method according to claim 1, wherein:

the settings information further comprises a third value relating to a third processing parameter of a second APD;

the one or more APDs comprises the second APD; and the control signal further causes the second APD to update the third processing parameter to the third value.

9. A method according to claim 8, wherein:

the settings information further comprises a fourth value relating to a fourth processing parameter of the second APD, and the control signal further causes the second APD to update the fourth processing parameter to the fourth value.

10. A method according to claim 8, further comprising:

receiving, by the control unit, an input audio signal; and transmitting, by the control unit, the input audio signal to the first APD to thereby cause:

the first APD to processes the input audio signal to a first processed audio signal based on the updated first processing parameter and the updated second processing parameter;

the first APD to transmit the first processed audio signal to the second APD; and the second APD to process the first processed audio signal to a second audio signal based on the updated third processing parameter.

11. A method according to claim 1, further comprising:

receiving, by the control unit, second settings information comprising an updated value relating to the first processing parameter of the first APD;

generating, by the control unit, a second control signal comprising the second settings information; and transmitting, by the control unit, the second control signal to the first APD to thereby cause the first APD to update the first processing parameter to the updated value.

12. A method comprising:

storing, by a control unit, a preset associated with settings information comprising:

a first value relating to a first processing parameter of a first audio processing device ("APD"); and a second value relating to a second processing parameter of a second APD;

receiving, by the control unit, an indication that a user has selected the preset;

upon said receiving the indication, generating, by the control unit, a control signal comprising the settings information; and transmitting, by the control unit, the control signal to one or more APDs in communication with the control unit, wherein the one or more APDs comprises the first APD and the second APD, wherein the control signal causes the first APD to update the first processing parameter to the first value, and wherein the control signal causes the second APD to update the second processing parameter to the second value.

13. A method according to claim 12, further comprising:

receiving, by the control unit, an input audio signal; and transmitting, by the control unit, the input audio signal to the first APD to thereby cause the first APD to processes the input audio signal to a first processed audio signal based on the updated first processing parameter.

14. A method according to claim 13, wherein said transmitting the input audio signal to the first APD further causes:

the first APD to transmit the first processed audio signal to the second APD; and the second APD to processes the first processed audio signal to a second processed audio signal based on the updated second processing parameter.

15. A method according to claim 13, wherein the input audio signal is received from an instrument in communication with the control unit.

16. A system comprising:

one or more audio processing devices ("APDs") comprising:

a first APD associated with a first processing parameter; and a second APD associated with a second processing parameter;

a database configured to store a preset associated with settings information comprising:

a first value relating to the first processing parameter; and a second value relating to the second processing parameter;

a user device configured to receive user input from a user; and a control unit in communication with the one or more APDs, the database, and the user device, the control unit configured to:

receive the user input from the user device;

upon determining that the user input comprises a selection of the preset, generate a control signal comprising the settings information; and transmit the control signal to the one or more APDs to thereby cause the first APD to update the first processing parameter to the first value and the second APD to update the second processing parameter to the second value.

17. The system of claim 16, further comprising:

an instrument in communication with the control unit, the instrument configured to generate an input audio signal, wherein the control unit is further configured to:

receive the input audio signal; and transmit the input audio signal to the one or more APDs for processing.

18. The system of claim 17, further comprising an audio output device in communication with the one or more APDs.

* * * * *